US009074782B2

(12) United States Patent
Kinoshita et al.

(10) Patent No.: US 9,074,782 B2
(45) Date of Patent: Jul. 7, 2015

(54) AIR CONDITIONER WITH ELECTROMAGNETIC INDUCTION HEATING UNIT

(75) Inventors: Hidehiko Kinoshita, Sakai (JP); Tsuyoshi Yamada, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 921 days.

(21) Appl. No.: 13/255,712

(22) PCT Filed: Mar. 15, 2010

(86) PCT No.: PCT/JP2010/001815

§ 371 (c)(1), (2), (4) Date: Sep. 9, 2011

(87) PCT Pub. No.: WO2010/106773

PCT Pub. Date: Sep. 23, 2010

(65) Prior Publication Data

US 2011/0314851 A1 Dec. 29, 2011

(30) Foreign Application Priority Data

Mar. 19, 2009 (JP) ..... 2009-069102

(51) Int. Cl.

*F25B 13/00* (2006.01)
*F24F 11/00* (2006.01)
*F25B 47/02* (2006.01)

(52) U.S. Cl.

CPC ..... *F24F 11/0009* (2013.01); *F24F 11/0012* (2013.01); *F24F 2011/0013* (2013.01); (Continued)

(58) Field of Classification Search

CPC ..... F25B 2400/01; F25B 2500/02
USPC ..... 62/159, 160, 238.6, 238.7
See application file for complete search history.

(56) References Cited

U.S. PATENT DOCUMENTS

2002/0056280 A1 5/2002 Kim
2003/0172667 A1 9/2003 Takano et al.

(Continued)

FOREIGN PATENT DOCUMENTS

JP 52-150056 U 11/1977
JP 56-148576 U 11/1981

(Continued)

OTHER PUBLICATIONS

Corrected Version of International Preliminary Report of related PCT Application No. PCT/JP2010/001941.

(Continued)

*Primary Examiner* — Jonathan Bradford
(74) *Attorney, Agent, or Firm* — Global IP Counselors

(57) ABSTRACT

An air conditioner includes a heat generating member, an electromagnetic induction heating unit, an air conditioning target space temperature detecting unit, an outdoor air temperature detecting unit, and a control unit. The heat generating member thermally contacts a refrigerant piping and/or refrigerant that flows through the refrigerant piping. The electromagnetic induction heating unit includes a magnetic field generating part that generating part generates a magnetic field in order to heat the heat generating member by induction heating. The control unit, when the refrigeration cycle is performing heating operation or defrosting operation, inhibits the generation of the magnetic field by the magnetic field generating part when the temperature of the space to be air conditioned and the outside air temperature do not satisfy a first prescribed condition or when a difference between a target set temperature and the temperature of the space does not satisfy a second prescribed condition.

4 Claims, 7 Drawing Sheets

(52) U.S. Cl.
CPC ..... *F25B13/00* (2013.01); *F25B 47/022* (2013.01); *F25B 2313/02741* (2013.01); *F25B 2400/01* (2013.01); *F25B 2700/2104* (2013.01); *F25B 2700/2106* (2013.01); *F25B 2500/02* (2013.01)

(56) References Cited

U.S. PATENT DOCUMENTS

| | | | | |
|---|---|---|---|---|
| 2003/0213256 | A1 | 11/2003 | Ueda et al. | |
| 2008/0078191 | A1* | 4/2008 | Morishita et al. | 62/126 |
| 2008/0098760 | A1* | 5/2008 | Seefeldt | 62/238.7 |

FOREIGN PATENT DOCUMENTS

| | | | |
|---|---|---|---|
| JP | 61-140738 | A | 6/1986 |
| JP | 61-246537 | A | 11/1986 |
| JP | 62-77574 | A | 4/1987 |
| JP | 1-111153 | | 4/1989 |
| JP | 3-59358 | A | 3/1991 |
| JP | 4-15446 | A | 1/1992 |
| JP | 4-80562 | A | 3/1992 |
| JP | 6-26696 | A | 2/1994 |
| JP | 7-301459 | A | 11/1995 |
| JP | 11-248265 | A | 9/1999 |
| JP | 2000-28180 | A | 1/2000 |
| JP | 2000-97510 | A | 4/2000 |
| JP | 2000-220912 | A | 8/2000 |
| JP | 2001-174055 | A | 6/2001 |
| JP | 2001-255025 | A | 9/2001 |
| JP | 2002-5537 | A | 1/2002 |
| JP | 2002-106980 | A | 4/2002 |
| JP | 2002-195669 | A | 7/2002 |
| JP | 2003-42574 | A | 2/2003 |
| JP | 2003-269810 | A | 9/2003 |
| JP | 2004-3804 | A | 1/2004 |
| JP | 2004-3827 | A | 1/2004 |
| JP | 2004-205071 | A | 7/2004 |
| JP | 2007-127381 | A | 5/2007 |
| JP | 2007-178114 | A | 7/2007 |
| JP | 2007-212035 | A | 8/2007 |
| JP | 2007-212036 | A | 8/2007 |
| JP | 2007-255736 | A | 10/2007 |
| JP | 2008-2790 | A | 1/2008 |
| JP | 2008-164226 | A | 7/2008 |
| WO | 2007/066585 | A1 | 6/2007 |
| WO | 2007/105669 | A1 | 9/2007 |
| WO | WO 2007/119414 | A1 | 10/2007 |

OTHER PUBLICATIONS

International Preliminary Report of corresponding PCT Application No. PCT/JP2010/001815.
International Preliminary Report of related PCT Application No. PCT/JP2010/001965.
International Preliminary Report of related PCT Application No. PCT/JP2010/002005.
International Preliminary Report of related PCT Application No. PCT/JP2010/001937.
International Preliminary Report of related PCT Application No. PCT/JP2010/001985.
International Preliminary Report of related PCT Application No. PCT/JP2010/001983.
International Preliminary Report of related PCT Application No. PCT/JP2010/001941.
International Preliminary Report of related PCT Application No. PCT/JP2010/001942.
International Preliminary Report of related PCT Application No. PCT/JP2010/001994.
International Search Report of corresponding PCT Application No. PCT/JP2010/001815.
International Search Report of corresponding PCT Application No. PCT/JP2010/001965.
International Search Report of corresponding PCT Application No. PCT/JP2010/001983.
International Search Report of corresponding PCT Application No. PCT/JP2010/001942.
International Search Report of corresponding PCT Application No. PCT/JP2010/001941.
International Search Report of corresponding PCT Application No. PCT/JP2010/001994.
International Search Report of corresponding PCT Application No. PCT/JP2010/002005.
International Search Report of corresponding PCT Application No. PCT/JP2010/001937.
International Search Report of corresponding PCT Application No. PCT/JP2010/001985.
European Search Report of corresponding EP Application No. 10 75 3270.7 dated Feb. 12, 2015.

* cited by examiner

AIR CONDITIONER WITH ELECTROMAGNETIC INDUCTION HEATING UNIT

CROSS-REFERENCE TO RELATED APPLICATIONS

This U.S. National stage application claims priority under 35 U.S.C. §119(a) to Japanese Patent Application No. 2009-069102, filed in Japan on Mar. 19, 2009, the entire contents of which are hereby incorporated herein by reference.

TECHNICAL FIELD

The present invention relates to an air conditioner that comprises: a refrigerant circuit, which connects a compressing mechanism, a condenser, an expansion mechanism, and an evaporator; and a heating unit, which heats a refrigerant inside the refrigerant circuit.

BACKGROUND ART

In the conventional art of air conditioners that are capable of heating operation, an air conditioner that comprises a refrigerant heating function for the purpose of increasing heating capacity has been proposed. For example, in an air conditioner according to Japanese Laid-open Patent Application Publication No. H06-26696, a refrigerant that flows through a refrigerant heater, which functions as an evaporator, is heated by a burner during heating operation. Here, in the air conditioner recited in Japanese Laid-open Patent Application Publication No. H06-26696, the amount of fuel that the burner burns is controlled during heating operation in accordance with a temperature difference between the temperature of the refrigerant on the inlet side of the refrigerant heater, which functions as an evaporator, and the temperature of the refrigerant on the outlet side of the refrigerant heater.

SUMMARY

Technical Problem

In the art described in Japanese Laid-open Patent Application Publication No. H06-26696, the amount of fuel that the burner burns during heating operation is adjusted in accordance with the temperature difference; however, because the burner burns continuously, there is a possibility that the burner will burn wastefully. For example, it is desirable to reduce the amount of heating output by the burner when the heating load is such that the refrigeration cycle alone—without any heating of the refrigerant—can sufficiently cover heating operation, but the burner performs heating anyway.

An object of the present invention is to provide an air conditioner that can prevent wasteful heating of a refrigerant in accordance with the heating load and can quickly perform heating operation either when the heating load is large or when the load demanded by defrosting operation is large, and thereby can make a space to be air conditioned comfortable.

Solution to Problem

An air conditioner according to a first aspect of the present invention is an air conditioner that comprises a refrigerant circuit, which connects a compressing mechanism, a heat source side heat exchanger, an expansion mechanism, and a utilization side heat exchanger, and wherein performing a refrigeration cycle that uses the refrigerant circuit air conditions a space to be air conditioned such that the temperature of the space to be air conditioned approaches a target set temperature. Furthermore, the air conditioner of the present invention comprises a heat generating member, an electromagnetic induction heating unit, an air conditioning target space temperature detecting unit, an outdoor air temperature detecting unit, and a control unit. The heat generating member thermally contacts a refrigerant piping and/or a refrigerant that flows through the refrigerant piping. The electromagnetic induction heating unit comprises a magnetic field generating part. The magnetic field generating part generates a magnetic field in order to heat the heat generating member by induction heating. The air conditioning target space temperature detecting unit detects the temperature of the space to be air conditioned. The outdoor air temperature detecting unit detects an outside air temperature. The control unit, when the refrigeration cycle is performing heating operation or defrosting operation, inhibits the generation of the magnetic field by the magnetic field generating part in the case wherein the temperature of the space to be air conditioned and the outside air temperature do not satisfy a first prescribed condition or the case wherein the temperature difference between the target set temperature and the temperature of the space to be air conditioned does not satisfy a second prescribed condition.

The air conditioner of the present invention comprises a refrigerant circuit that comprises an electromagnetic induction heating unit that, by virtue of the magnetic field generating part heating the heat generating member by induction heating, heats the refrigerant piping, which thermally contacts the heat generating member, and/or the refrigerant that flows through the refrigerant piping. Namely, in this air conditioner, the refrigerant that flows through the refrigerant piping can be heated by causing the electromagnetic induction heating unit to operate. In the present invention, in such an air conditioner, the control unit permits the electromagnetic induction heating unit to be operated (i.e., permits the magnetic field generating part to generate a magnetic field) if the temperature of the space to be air conditioned and the outside air temperature satisfy the first prescribed condition and the temperature difference between the target set temperature and the temperature of the space to be air conditioned satisfies the second prescribed condition.

Thus, the control unit determines the magnitude of the heating load of the space to be air conditioned or the load demanded by defrosting operation by determining whether the temperature of the space to be air conditioned and the outside air temperature satisfy the first prescribed condition and whether the temperature difference between the target set temperature and the temperature of the space to be air conditioned satisfies the second prescribed condition. Accordingly, the control unit can cause the electromagnetic induction heating unit to operate only when the heating load or the load demanded by defrosting operation is large and heating of the refrigerant by the electromagnetic induction heating unit is necessary. Consequently, if the heating load or the load demanded by defrosting operation is large, then the operation of heating the space to be air conditioned can be performed quickly and thereby a comfortable space can be provided for the user. In addition, because the electromagnetic induction heating unit is not operated wastefully, it is possible to reduce energy consumption.

An air conditioner according to a second aspect of the present invention is the air conditioner according to the first aspect of the present invention, wherein the heat generating member includes a ferromagnetic material.

In this air conditioner, heating by electromagnetic induction can be performed efficiently because the magnetic field generating part is caused to generate a magnetic field in a portion that includes the ferromagnetic material.

An air conditioner according to a third aspect of the present invention is the air conditioner according to the first or second aspects of the present invention, wherein the case wherein the temperature of the space to be air conditioned and the outside air temperature satisfy the first prescribed condition is the case wherein the temperature of the space to be air conditioned and the outside air temperature are in a first temperature region at the startup of the heating operation or during the defrosting operation. The case wherein the temperature difference satisfies the second prescribed condition is the case wherein the temperature difference exceeds a first prescribed temperature at the startup of the heating operation or during defrosting operation.

In the air conditioner of the present invention, the control unit determines that the heating load of the space to be air conditioned or the load demanded by the defrosting operation is large if, at the startup of heating operation or during defrosting operation, the temperature of the space to be air conditioned and the outside air temperature are in the first temperature region and the temperature difference exceeds the first prescribed temperature.

Accordingly, the control unit can cause the electromagnetic induction heating unit to operate at the startup of heating operation and during defrosting operation only when the heating load is large and heating of the refrigerant by the electromagnetic induction heating unit is necessary. Consequently, if the heating load is large, then the operation of heating the space to be air conditioned can be performed quickly and thereby a comfortable space can be provided for the user. In addition, because the electromagnetic induction heating unit is not operated wastefully, it is possible to reduce energy consumption.

An air conditioner according to a fourth aspect of the present invention is the air conditioner according to the third aspect of the present invention, wherein the control unit further inhibits the generation of the magnetic field by the magnetic field generating part if the rotational frequency of the compressing mechanism is less than or equal to a prescribed frequency at the startup of the heating operation or during defrosting operation.

Accordingly, the control unit can cause the electromagnetic induction heating unit to operate at the startup of heating operation or during defrosting operation only when the heating load is large and it is necessary for the electromagnetic induction heating unit to heat the refrigerant. Consequently, during the startup of heating operation, supplementary heating can be performed only if the heating load is large, and consequently heating operation can be started up quickly. In addition, during defrosting operation, supplementary heating can be performed only if the load demanded by defrosting operation is large, and consequently the time needed to perform defrosting operation can be shortened. In addition, because the electromagnetic induction heating unit is not operated wastefully, it is possible to reduce energy consumption.

An air conditioner according to a fifth aspect of the present invention is the air conditioner according to the third or fourth aspects of the present invention, wherein the control unit further inhibits the generation of the magnetic field by the magnetic field generating part during heating operation, excepting at the startup of the heating operation, in the case wherein the rotational frequency of the compressing mechanism is less than or equal to the prescribed frequency or the case wherein the temperature of the space to be air conditioned and the outside air temperature deviate from a second temperature region.

In the air conditioner of the present invention, the control unit determines that the heating load of the space to be air conditioned is large if, during heating operation excepting at the startup of heating operation, the rotational frequency of the compressing mechanism exceeds the prescribed frequency and the temperature of the space to be air conditioned and the outside air temperature are in the second temperature region.

Accordingly, the control unit can cause the electromagnetic induction heating unit to operate during heating operation excepting at the startup of heating operation (i.e., during regular heating operation) only when the heating load is large and heating of the refrigerant by the electromagnetic induction heating unit is necessary. Consequently, if the heating load is large, then the operation of heating the space to be air conditioned can be performed quickly and thereby a comfortable space can be provided for the user. In addition, because the electromagnetic induction heating unit is not operated wastefully, it is possible to reduce energy consumption.

An air conditioner according to a sixth aspect of the present invention is the air conditioner according to the fifth aspect of the present invention, wherein the second temperature region is narrower than the first temperature region.

In the air conditioner of the present invention, the electromagnetic induction heating unit is operated under stricter conditions during regular heating operation than at the startup of heating operation. During regular heating operation, the compressor is in the state wherein it is already running, and consequently is in a warmer state than at the startup of heating operation. Consequently, regardless of whether it is determined, that heating of the refrigerant is necessary or unnecessary in the second temperature region at the startup of heating operation, which is narrower than the first temperature region, the heating load can be made to track heating capacity sufficiently and quickly during regular heating operation.

Thus, by making the determination during regular heating operation using a temperature condition that is narrower than that used at the startup of heating operation, the control unit can prevent the wasteful heating of the refrigerant more than would be the case if the magnitude of the heating load were determined using the same temperature region for the startup of the heating operation as for regular heating operation. Consequently, energy consumption can be reduced.

Advantageous Effects of Invention

In the air conditioner according to the first aspect of the present invention, the control unit determines the magnitude of the heating load of the space to be air conditioned or the load demanded by defrosting operation by determining whether the temperature of the space to be air conditioned and the outside air temperature satisfy the first prescribed condition and whether the temperature difference between the target set temperature and the temperature of the space to be air conditioned satisfies the second prescribed condition. Accordingly, the control unit can cause the electromagnetic induction heating unit to operate only when the heating load or the load demanded by defrosting operation is large and heating of the refrigerant by the electromagnetic induction heating unit is necessary. Consequently, if the heating load or the load demanded by defrosting operation is large, then the operation of heating the space to be air conditioned can be performed quickly and thereby a comfortable space can be provided for the user. In addition, because the electromagnetic induction heating unit is not operated wastefully, it is possible to reduce energy consumption.

In the air conditioner according to the second aspect of the present invention, heating by electromagnetic induction can be performed efficiently because the magnetic field generating part is caused to generate a magnetic field in a portion that includes the ferromagnetic material.

In the air conditioner according to the third aspect of the present invention, the control unit can cause the electromagnetic induction heating unit to operate at the startup of heating operation and during defrosting operation only when the heating load is large and heating of the refrigerant by the electromagnetic induction heating unit is necessary. Consequently, if the heating load is large, then the operation of heating the space to be air conditioned can be performed quickly and thereby a comfortable space can be provided for the user. In addition, because the electromagnetic induction heating unit is not operated wastefully, it is possible to reduce energy consumption.

In the air conditioner according to the fourth aspect of the present invention, the control unit can cause the electromagnetic induction heating unit to operate at the startup of heating operation or during defrosting operation only when the heating load is large and it is necessary for the electromagnetic induction heating unit to heat the refrigerant. Consequently, during the startup of heating operation, supplementary heating can be performed only if the heating load is large, and consequently heating operation can be started up quickly. In addition, during defrosting operation, supplementary heating can be performed only if the load demanded by defrosting operation is large, and consequently the time needed to perform defrosting operation can be shortened. In addition, because the electromagnetic induction heating unit is not operated wastefully, it is possible to reduce energy consumption.

In the air conditioner according to the fifth aspect of the present invention, the control unit can cause the electromagnetic induction heating unit to operate during heating operation excepting at the startup of heating operation (i.e., during regular heating operation) only when the heating load is large and heating of the refrigerant by the electromagnetic induction heating unit is necessary. Consequently, if the heating load is large, then the operation of heating the space to be air conditioned can be performed quickly and thereby a comfortable space can be provided for the user. In addition, because the electromagnetic induction heating unit is not operated wastefully, it is possible to reduce energy consumption.

In the air conditioner according to the sixth aspect of the present invention, by making the determination during regular heating operation using a temperature condition that is narrower than that used at the startup of heating operation, the control unit can prevent the wasteful heating of the refrigerant more than would be the case if the magnitude of the heating load were determined using the same temperature region for the startup of the heating operation as for regular heating operation. Consequently, energy consumption can be reduced.

DETAILED DESCRIPTION OF THE PREFERRED EMBODIMENTS

The embodiments of the present invention will now be explained, referencing the drawings. Furthermore, the embodiments below are merely illustrative examples of the present invention and do not limit its technical scope.

<Air Conditioner>

Figure 1:
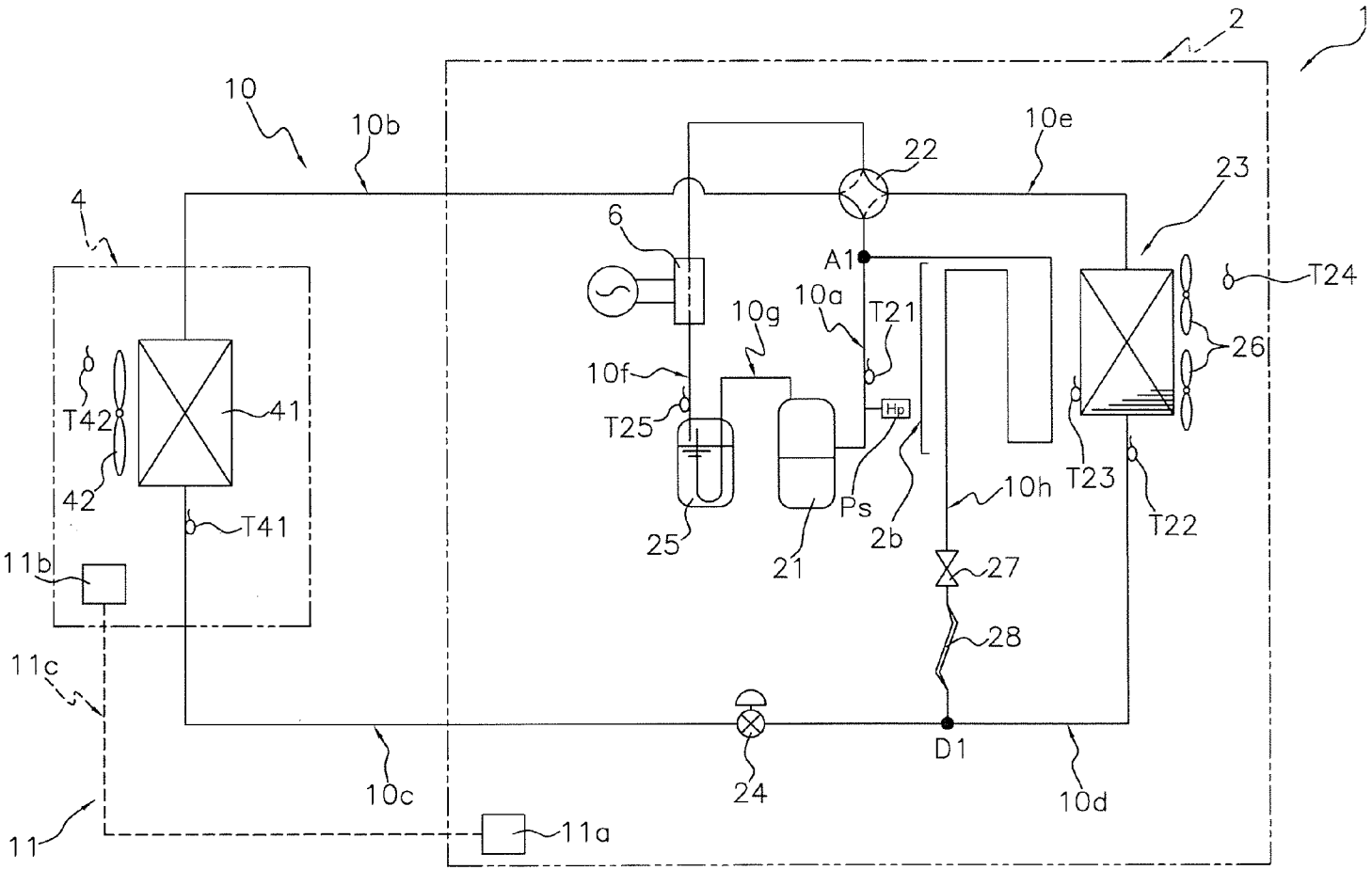
FIG. 1 is a refrigerant circuit diagram of an air conditioner that uses a refrigeration apparatus according to one embodiment of the present invention.

FIG. 1 is a block diagram of an air conditioner that uses a refrigeration apparatus according to one embodiment of the present invention. In an air conditioner 1 in FIG. 1, an outdoor unit 2, which serves as a heat source unit, and an indoor unit 4, which serves as a utilization unit, are connected by refrigerant pipings, and thereby a refrigerant circuit 10 that performs a vapor compression type refrigeration cycle is formed.

The outdoor unit 2 houses a compressor 21, a four-way switching valve 22, an outdoor heat exchanger 23, a motor operated expansion valve 24, an accumulator 25, outdoor fans 26, a hot gas bypass valve 27, a capillary tube 28, and an electromagnetic induction heating unit 6. The indoor unit 4 houses an indoor heat exchanger 41 and an indoor fan 42.

The refrigerant circuit 10 comprises a discharge pipe 10*a*, a gas pipe 10*b*, a liquid pipe 10*c*, an outdoor side liquid pipe 10*d*, an outdoor side gas pipe 10*e*, an accumulator pipe 10*f*, a suction pipe 10*g*, and a hot gas bypass 10*h*.

The discharge pipe 10*a* connects the compressor 21 and the four-way switching valve 22. The gas pipe 10*b* connects the four-way switching valve 22 and the indoor heat exchanger 41. The liquid pipe 10*c* connects the indoor heat exchanger 41 and the motor operated expansion valve 24. The outdoor side liquid pipe 10*d* connects the motor operated expansion valve 24 and the outdoor heat exchanger 23. The outdoor side gas pipe 10*e* connects the outdoor heat exchanger 23 and the four-way switching valve 22.

The accumulator pipe 10*f* connects the four-way switching valve 22 and the accumulator 25. The electromagnetic induction heating unit 6 is mounted to one portion of the accumulator pipe 10*f*. At least the portion of the accumulator pipe 10*f* that is covered by the electromagnetic induction heating unit 6 and is to be heated is a copper pipe wrapped in a stainless steel pipe. Of the piping that constitutes the refrigerant circuit 10, the portion outside of the stainless steel pipe is copper pipe.

The suction pipe 10*g* connects the accumulator 25 and the inlet side of the compressor 21. The hot gas bypass 10*h* connects a branching point A1, which is provided along the discharge pipe 10*a*, and a branching point D1, which is provided along the outdoor side liquid pipe 10*d*.

The hot gas bypass valve 27 is disposed along the hot gas bypass 10*h*. To switch between the state wherein the flow of the refrigerant through the hot gas bypass 10*h* is permitted and the state wherein it is not permitted, a control unit 11 opens and closes the hot gas bypass valve 27. In addition, the capillary tube 28, wherein the cross sectional area of the refrigerant channel is reduced, is provided on the downstream side of the hot gas bypass valve 27; furthermore, during defrosting operation, a constant ratio of the refrigerant that flows through the outdoor heat exchanger 23 to the refrigerant that flows through the hot gas bypass 10*h* is maintained.

The four-way switching valve 22 can switch between a cooling operation cycle and a heating operation cycle. In FIG. 1, solid lines indicate the connection state for performing heating operation, and dotted lines indicate the connection state for performing cooling operation. During heating operation, the indoor heat exchanger 41 functions as a condenser, and the outdoor heat exchanger 23 functions as an evaporator. During cooling operation, the outdoor heat exchanger 23 functions as a condenser, and the indoor heat exchanger 41 functions as an evaporator.

The outdoor fans 26, which deliver outdoor air to the outdoor heat exchanger 23, are provided in the vicinity of the outdoor heat exchanger 23. The indoor fan 42, which delivers indoor air to the indoor heat exchanger 41, is provided in the vicinity of the indoor heat exchanger 41.

In addition, various sensors are provided to the outdoor unit 2 and the indoor unit 4.

Specifically, the outdoor unit 2 is provided with: a discharge pressure sensor Ps, which detects a discharge pressure (i.e., a high-pressure pressure Ph) of the compressor 21; a discharge temperature sensor T21, which detects a discharge temperature Td of the compressor 21; a first liquid side temperature sensor T22, which detects a temperature of the refrigerant in the liquid state or the vapor-liquid two-phase state on the liquid side of the outdoor heat exchanger 23; an outdoor heat exchanger sensor T23, which detects a temperature (i.e., an outdoor heat exchanger temperature Tm) of the outdoor heat exchanger 23; and an inlet temperature sensor T25, which detects an inlet temperature (i.e., a suction temperature Tsu) of the accumulator 25. In addition, an outdoor temperature sensor T24, which detects the temperature of the outdoor air that flows into the outdoor unit 2 (i.e., the outdoor air temperature Ta), is provided to the outdoor air suction port side of the outdoor unit 2.

In addition, in the indoor unit 4, a second liquid side temperature sensor T41, which detects the temperature of the refrigerant (i.e., the condensing temperature during the heating operation or the refrigerant temperature that corresponds to the evaporating temperature during the cooling operation), is provided to the liquid side of the indoor heat exchanger 41. An indoor temperature sensor T42, which detects the temperature of the indoor air (i.e., an indoor temperature Tr) that flows into the indoor unit 4, is provided to the indoor air suction port side of the indoor unit 4. In the present embodiment, the discharge temperature sensor T21, the first liquid side temperature sensor T22, the outdoor heat exchanger temperature sensor T23, the outdoor temperature sensor T24, the inlet temperature sensor T25, the second liquid side temperature sensor T41, and the indoor temperature sensor T42 are each a thermistor.

The control unit 11 comprises an outdoor control unit 11*a* and an indoor control unit 11*b*. The outdoor control unit 11*a* and the indoor control unit 11*b* are connected by a communication line 11*c*. Furthermore, the outdoor control unit 11*a* controls equipment disposed inside the outdoor unit 2, and the indoor control unit 11*b* controls equipment disposed inside the indoor unit 4. Furthermore, the control unit 11 is connected such that it can receive detection signals of the various sensors Ps, T21-T25, T41, T42 and such that it can control various valves and equipment 6, 21, 22, 24, 26, 42 based on those detection signals and the like.

(External Appearance of Outdoor Unit)

Figure 2:
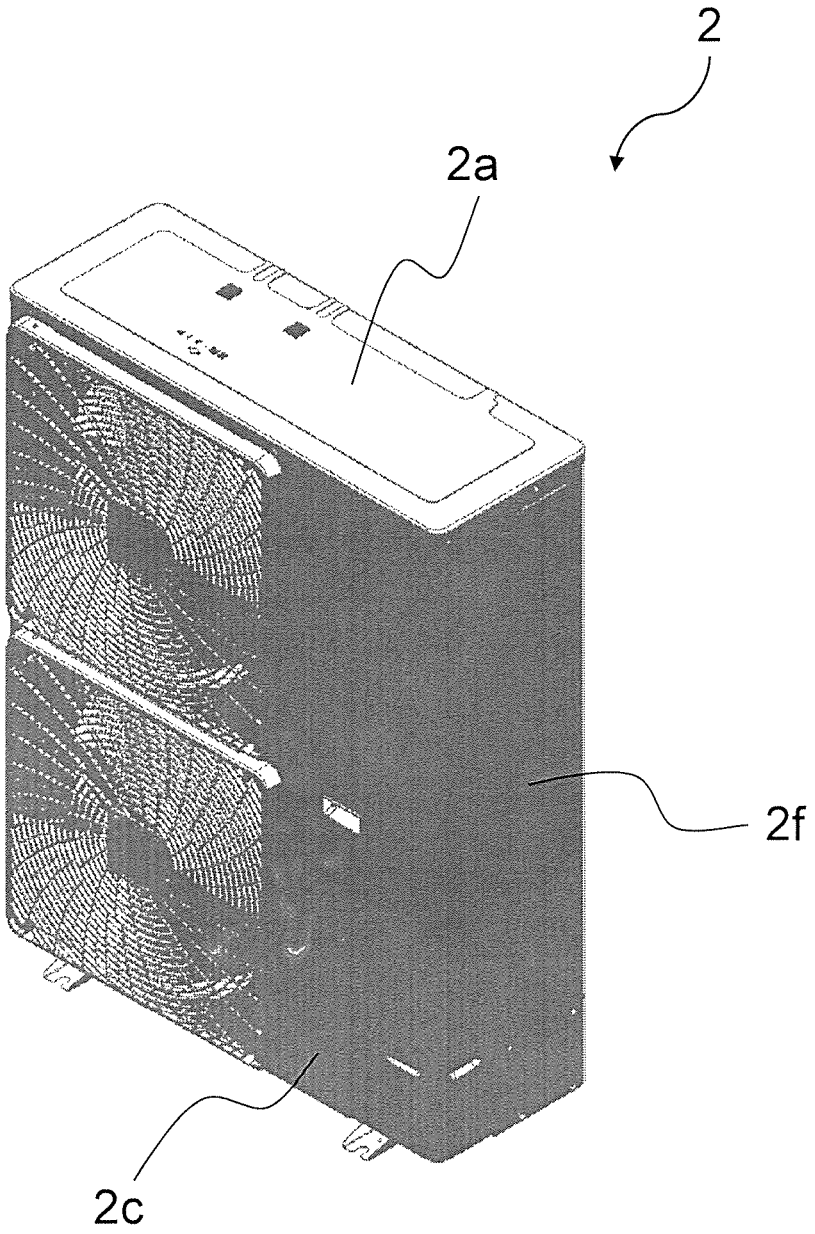
FIG. 2 is an external oblique view of an outdoor unit, viewed from the front surface side.
Figure 3:
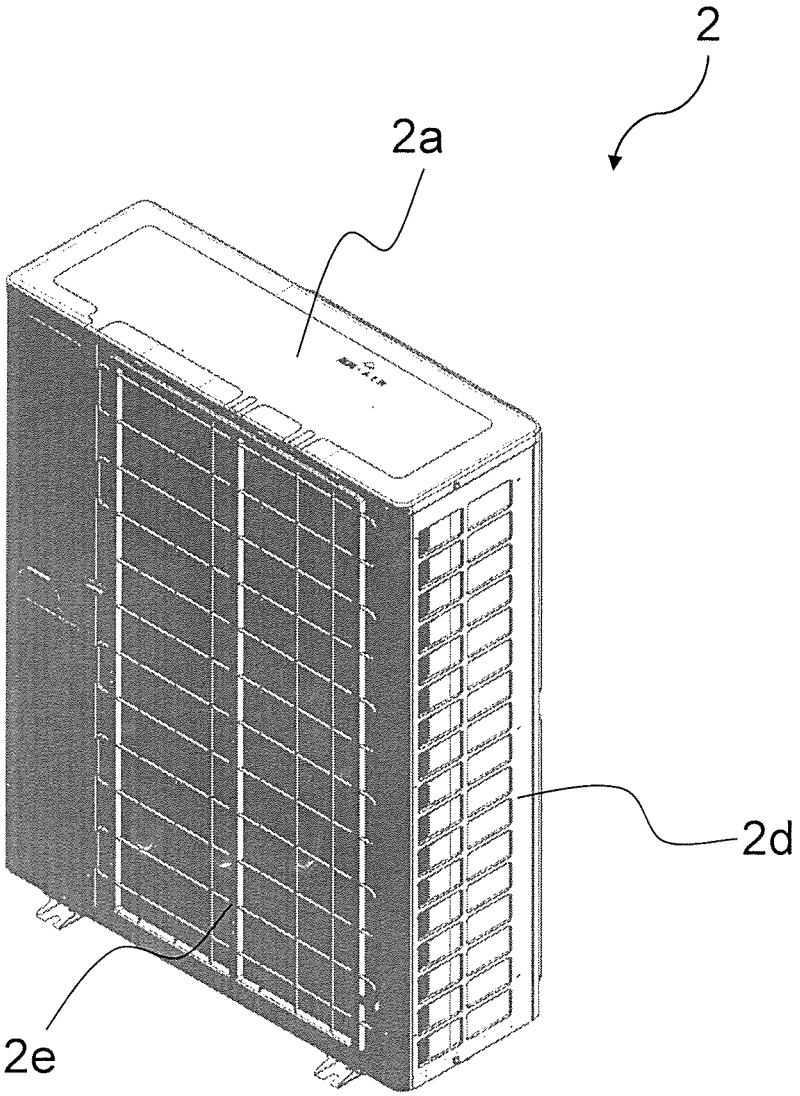
FIG. 3 is an external oblique view of the outdoor unit, viewed from the rear surface side.

FIG. 2 is an external oblique view of the outdoor unit 2, viewed from the front surface side, and FIG. 3 is an external oblique view of the outdoor unit 2, viewed from the rear surface side. In FIG. 2 to FIG. 5, a shell of the outdoor unit 2 is formed as a substantially rectangular parallelepiped by a top plate 2*a*, a bottom plate 2*b*, a front panel 2*c*, a left side surface panel 2*d*, a right side surface panel 2*f*, and a rear surface panel 2*e*.

(Interior of the Outdoor Unit)

Figure 4:
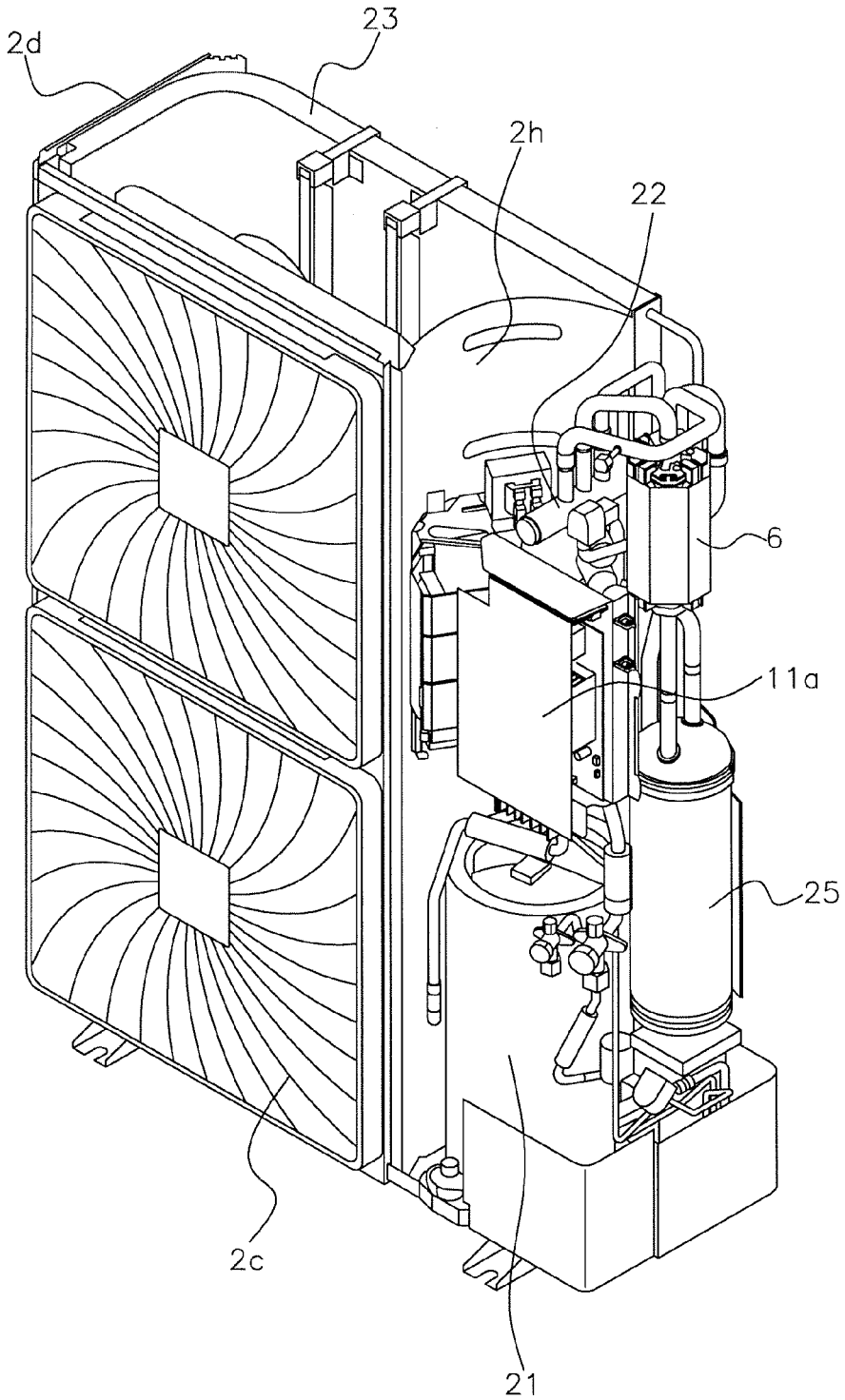
FIG. 4 is an oblique view of the outdoor unit with the right side surface panel and the rear surface panel removed.

FIG. 4 is an oblique view of the outdoor unit 2 with the right side surface panel and the rear surface panel removed. In FIG. 4, a partition plate 2*h* partitions the outdoor unit 2 into a fan chamber and a machine chamber. The outdoor heat exchanger 23 and the outdoor fans 26 (refer to FIG. 1) are disposed in the fan chamber, and the electromagnetic induction heating unit 6, the compressor 21, and the accumulator 25 are disposed in the machine chamber.

(Structure of Vicinity of Bottom Plate of Outdoor Unit)

Figure 5:
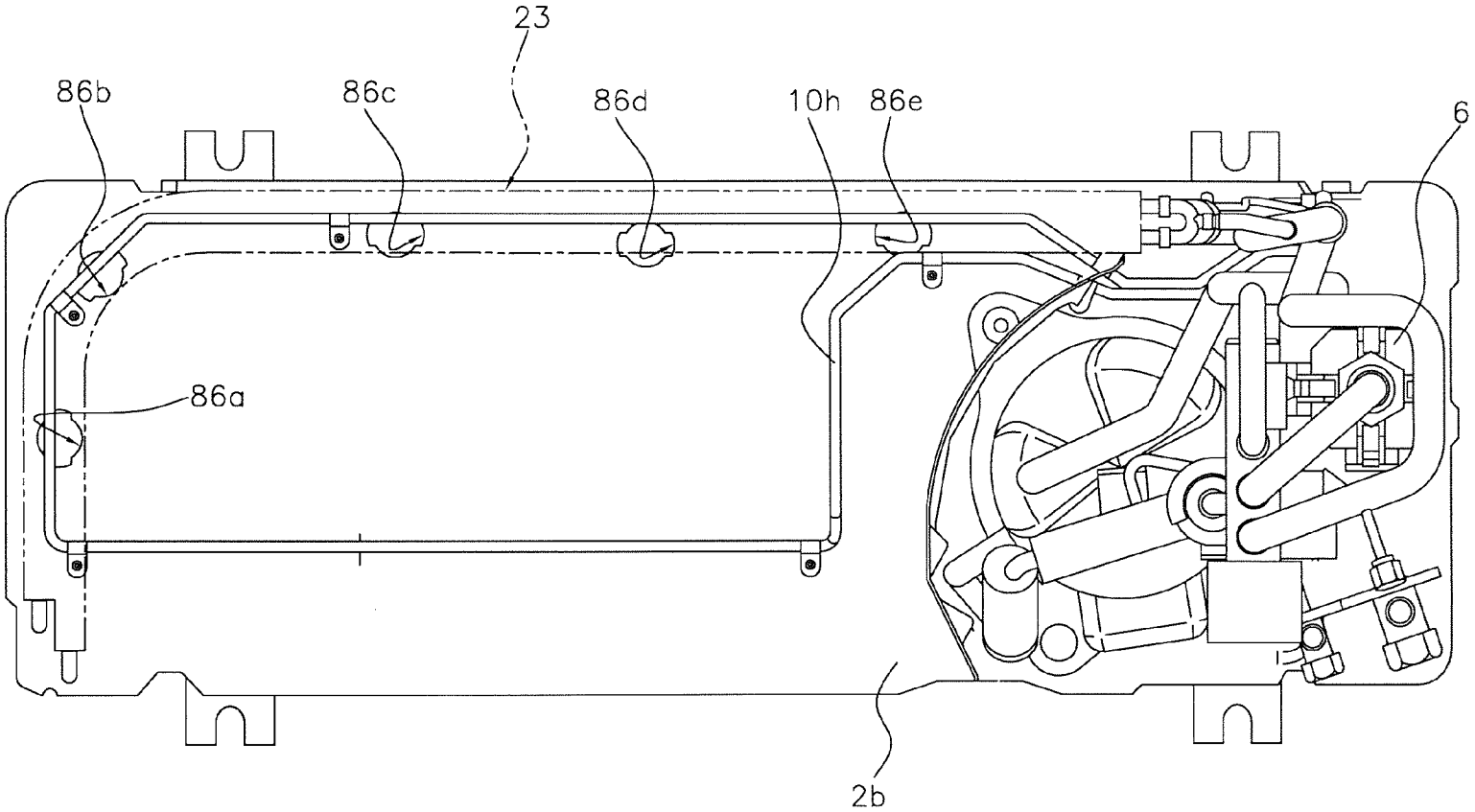
FIG. 5 is a plan view of the outdoor unit with only the bottom plate and the machine chamber remaining.

FIG. 5 is a plan view of the outdoor unit 2 with only the bottom plate 2*b* and the machine chamber remaining. Furthermore, in FIG. 5, chain double-dashed lines are used to represent the outdoor heat exchanger 23 so that its position is known. The hot gas bypass 10*h* is disposed above the bottom plate 2*b*, extends from the machine chamber, wherein the compressor 21 is positioned, to the fan chamber, makes a circuit through the fan chamber, and then returns to the machine chamber. Approximately half of the overall length of the hot gas bypass 10*h* lies below the outdoor heat exchanger 23. In addition, water discharge ports 86*a*-86*e*, which pass through the bottom plate 2*b* in the plate thickness directions, are formed in portions of the bottom plate 2*b* that are positioned below the outdoor heat exchanger 23.

(Electromagnetic Induction Heating Unit)

Figure 6:
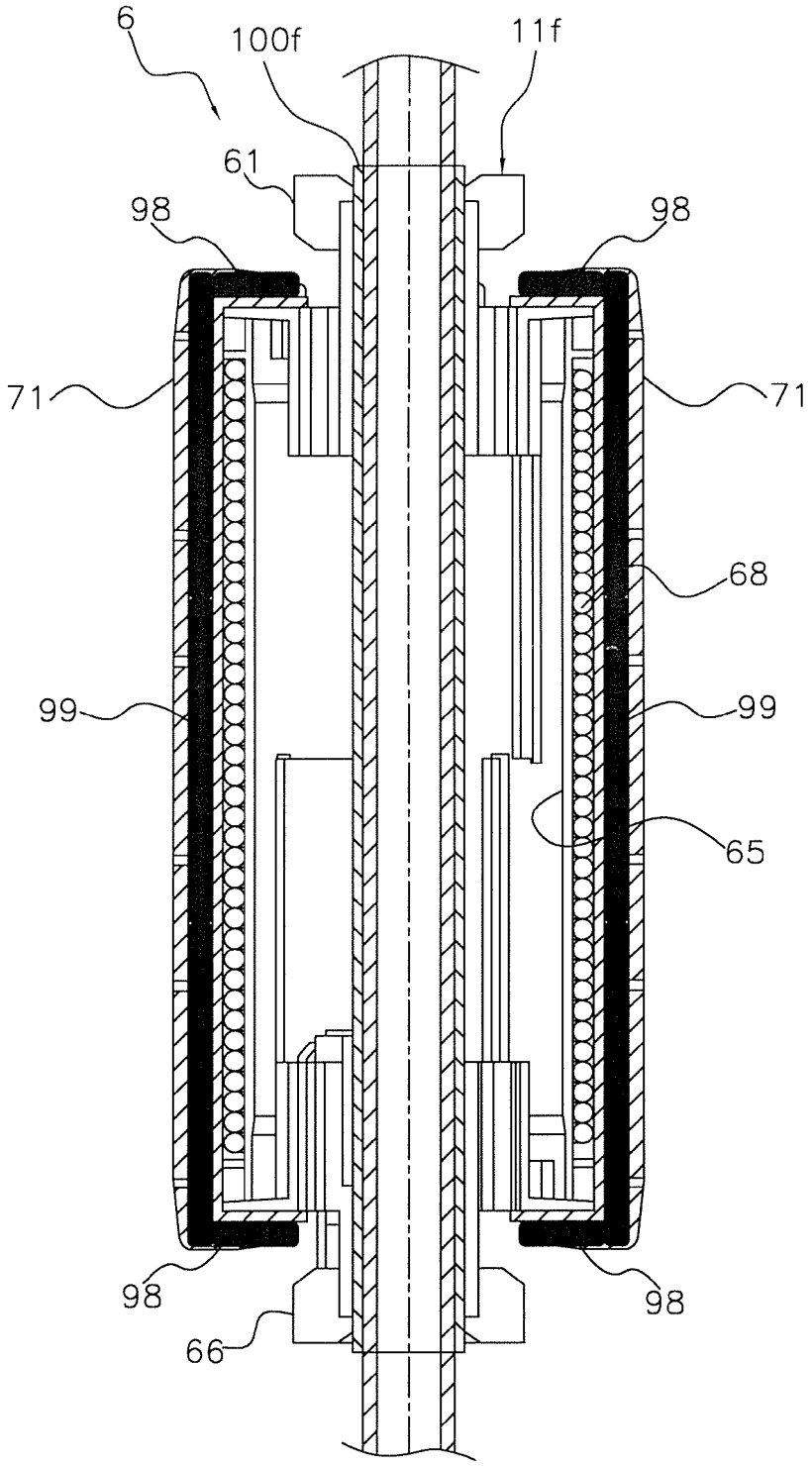
FIG. 6 is a cross sectional view of an electromagnetic induction heating unit.

FIG. 6 is a cross sectional view of the electromagnetic induction heating unit 6. In FIG. 6, the electromagnetic induction heating unit 6 is disposed such that the portion 11*f* of the accumulator pipe 10*f* that is to be heated is covered from the outer side in the radial directions and heated by electromagnetic induction. The portion 11*f* of the accumulator pipe 10*f* to be heated has a double pipe structure comprising a copper pipe on the inner side and a stainless steel pipe 100*f* on the outer side. Ferritic stainless steel that contains 16%-18% chrome or precipitation hardening stainless steel that contains 3%-5% nickel, 15%-17.5% chrome, and 3%-5% copper is used as the stainless steel material of the stainless steel pipe 100*f*.

First, the electromagnetic induction heating unit 6 is positioned at the accumulator pipe 10*f*; next, the vicinity of the upper end of the electromagnetic induction heating unit 6 is fixed by a first hex nut 61; lastly, the vicinity of the lower end of the electromagnetic induction heating unit 6 is fixed by a second hex nut 66.

A coil 68 is wound helically around the outer side of a bobbin main body 65, with the directions in which the accumulator pipe 10*f* extends being the axial directions of the winding. The coil 68 is housed on the inner side of a ferrite case 71. The ferrite case 71 further houses first ferrite parts 98 and second ferrite parts 99.

The first ferrite parts 98 are formed from ferrite, which has high magnetic permeability; furthermore, when an electric current flows to the coil 68, the first ferrite parts 98 capture the magnetic flux generated even in portions outside of the stainless steel pipe 100*f* and form a path for that magnetic flux. The first ferrite parts 98 are positioned on both end sides of the ferrite case 71.

Although their placement positions and shapes differ from those of the first ferrite parts 98, the second ferrite parts 99 function in the same manner as the first ferrite parts 98 and are positioned in the housing part of the ferrite case 71 in the vicinity of the outer side of the bobbin main body 65.

<Operation of Air Conditioner>

In the air conditioner 1, the four-way switching valve 22 is capable of switching between cooling operation and heating operation.

(Cooling Operation)

In cooling operation, the four-way switching valve 22 is set to the state indicated by the dotted lines in FIG. 1. When the compressor 21 is operated in this state, a vapor compression refrigeration cycle is performed in the refrigerant circuit 10 wherein the outdoor heat exchanger 23 becomes a condenser and the indoor heat exchanger 41 becomes an evaporator.

The outdoor heat exchanger 23 exchanges the heat of the high pressure refrigerant discharged from the compressor 21 with the outdoor air, whereupon the refrigerant condenses. When the refrigerant that passed through the outdoor heat exchanger 23 passes through the expansion valve 24, the refrigerant's pressure is reduced; subsequently, the indoor heat exchanger 41 exchanges the heat of the refrigerant with the indoor air, whereupon the refrigerant evaporates. Furthermore, the indoor air, whose temperature has dropped owing to the exchange of its heat with the refrigerant, is blown out to a space to be air conditioned. The refrigerant that passed through the indoor heat exchanger 41 is suctioned into the compressor 21 and compressed.

(Heating Operation)

In the heating operation, the four-way switching valve 22 is set to the state indicated by the solid lines in FIG. 1. When the compressor 21 is operated in this state, the vapor compression refrigeration cycle is performed in the refrigerant circuit 10, wherein the outdoor heat exchanger 23 becomes an evaporator and the indoor heat exchanger 41 becomes a condenser.

The indoor heat exchanger 41 exchanges the heat of the high pressure refrigerant discharged from the compressor 21 with the indoor air, whereupon the refrigerant condenses. Furthermore, the indoor air, whose temperature has risen owing to the exchange of its heat with the refrigerant, is blown out to the space to be air conditioned. When the condensed refrigerant passes through the expansion valve 24, the refrigerant's pressure is reduced; subsequently, the outdoor heat exchanger 23 exchanges the heat of the refrigerant with the outdoor air, whereupon the refrigerant evaporates. The refrigerant that passed through the outdoor heat exchanger 23 is suctioned into the compressor 21, where it is compressed.

In heating operation, capacity shortfall can be supplemented at startup, particularly when the compressor 21 is not sufficiently warmed up, by the electromagnetic induction heating unit 6 heating the refrigerant.

(Defrosting Operation)

When the outdoor air temperature is between −5° C. and +5° C. and heating operation has been performed, moisture contained in the air either condenses on the surface of the outdoor heat exchanger 23 and then turns to frost or freezes and covers the surface of the outdoor heat exchanger 23, in both cases reducing heat exchange performance. The defrosting operation is performed to melt the frost or ice adhered to the outdoor heat exchanger 23. The defrosting operation is performed with the same cycle as that of the cooling operation.

The heat of the high pressure refrigerant discharged from the compressor 21 is exchanged with the outdoor air by the outdoor heat exchanger 23, whereupon the refrigerant condenses. The heat radiated from that refrigerant melts the frost or ice covering the outdoor heat exchanger 23. When the condensed refrigerant passes through the expansion valve 24, its pressure is reduced; subsequently, the indoor heat exchanger 41 exchanges the heat of the refrigerant with the indoor air, whereupon the refrigerant evaporates. At this time, the indoor fan 42 is stopped. This is because if the indoor fan 42 were operating, then cooled air would be blown out to the space to be air conditioned, which would adversely affect user comfort. Furthermore, the refrigerant that passed through the indoor heat exchanger 41 is suctioned into the compressor 21 and compressed.

In addition, during defrosting operation, the electromagnetic induction heating unit 6 heats the accumulator pipe 10*f*, and thereby the compressor 21 can compress the heated refrigerant. As a result, the temperature of the gas refrigerant discharged from the compressor 21 rises, and the time needed to melt the frost decreases. Furthermore, the time needed to return from the defrosting operation back to the heating operation shortens.

In addition, during defrosting operation, the high pressure refrigerant discharged from the compressor 21 flows also to the hot gas bypass 10*h*. Even if ice grows on the bottom plate 2*b* of the outdoor unit 2, that ice is melted by the heat radiated from the refrigerant that passes through the hot gas bypass 10*h*. The water produced at that time is discharged via the water discharge ports 86*a*-86*e*. In addition, the hot gas bypass 10*h* also heats the water discharge ports 86*a*-86*e*, which prevents the water discharge ports 86*a*-86*e* from freezing and getting plugged up.

<Electromagnetic Induction Heating Unit Operation Permitted Condition>

If the heating load during heating operation is large or if the load demanded by the defrosting operation is large, then the control unit permits the operation of the electromagnetic induction heating unit 6. Namely, only if the heating load is large or the load demanded by the defrosting operation is large, then the electromagnetic induction heating unit 6 is permitted to heat the refrigerant and thereby to supplement the heating capacity or to supplement the defrosting capacity of defrosting operation. In the air conditioner 1 according to the present embodiment, the conditions under which the electromagnetic induction heating unit 6 is permitted to operate differs for the case of heating operation startup or defrosting operation and for the cases other than heating operation startup (i.e., regular heating operation).

Figure 7:
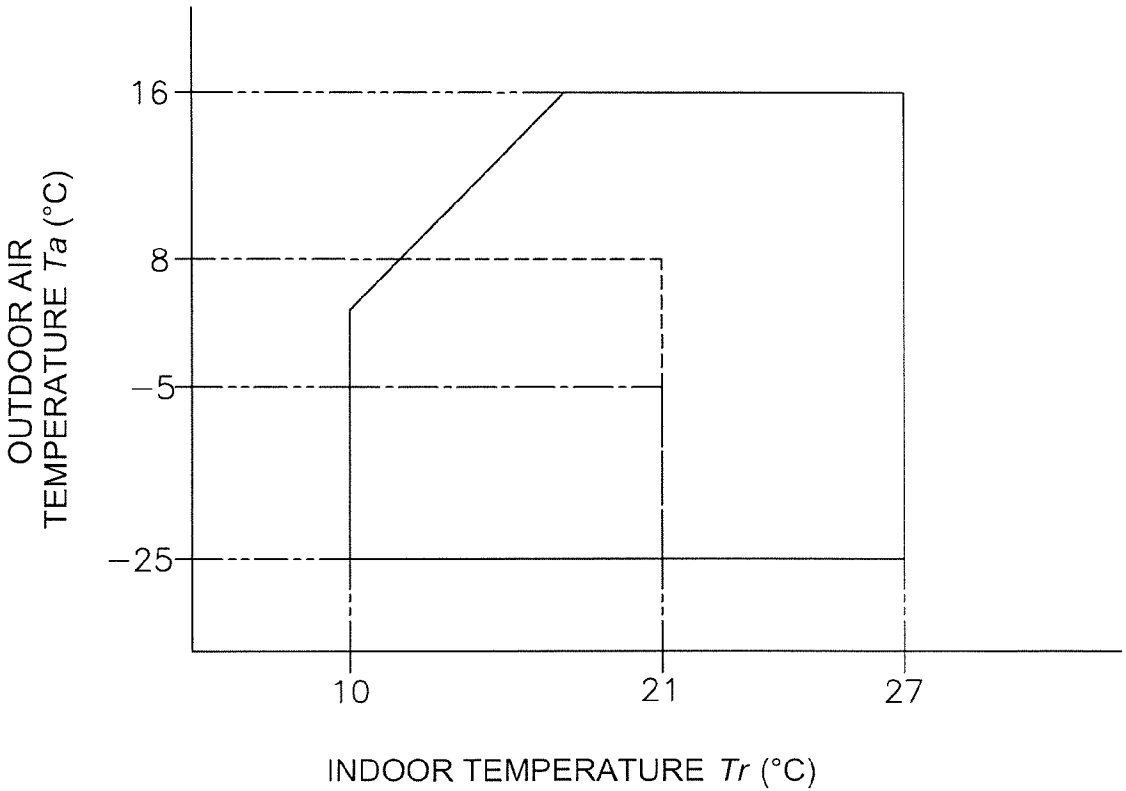
FIG. 7 is a graph that shows, as temperature regions, a heating operation permitted condition, an electromagnetic induction heating unit operation permitted condition at startup and during defrosting operation, and an electromagnetic induction heating unit operation permitted condition during regular heating operation based on the relationship between an outside air temperature and an indoor temperature.

Incidentally, heating operation performed by the air conditioner 1 according to the present embodiment is performed under the temperature condition enclosed by the solid lines in FIG. 7. Here, FIG. 7 shows as temperature regions a heating operation permitted condition, an electromagnetic induction heating unit operation permitted condition at startup and during defrosting operation, and an electromagnetic induction heating unit operation permitted condition during regular heating operation based on the relationship between an outside air temperature and an indoor temperature. Furthermore, if the outside air temperature Ta is high and the indoor temperature Tr is low (e.g., if the outside air temperature Ta is 15° C. and the indoor temperature Tr is 10° C.), then heating operation is not permitted and the temperature region of the heating operation permitted condition in FIG. 7 is a quadrilateral with a missing corner, namely, a pentagon. The heating operation permitted region is incomplete because, in the missing region, the outside air temperature Ta is high and the indoor temperature Tr is low and consequently the indoor temperature Tr can be increased by taking in the outside air as is without performing heating operation. Accordingly, energy consumption can be reduced by permitting heating operation in such a temperature region.

The text below separately explains, referencing FIG. 7, the electromagnetic induction heating unit operation permitted condition for two cases: at heating operation startup or during defrosting operation; and during regular heating operation.

(Operation Permitted Condition at Heating Operation Startup or During Defrosting Operation)

At heating operation startup or during defrosting operation, the control unit 11 permits the operation of the electromagnetic induction heating unit 6 if the range of the outside air temperature Ta is Ta<8° C. (refer to the broken line in FIG. 7); the range of the indoor temperature Tr is Tr<21° C. (refer to the broken line in FIG. 7); a temperature difference ΔTrs calculated by subtracting the indoor temperature Tr detected by the indoor temperature sensor T42 from the indoor set temperature Tse, which serves as the indoor space target set temperature set by an inputting unit (not shown) such as a remote control, exceeds 1K; and the rotational frequency of the compressor 21 exceeds a maximum frequency (in the present embodiment, 184 Hz). Conversely, if the operation permitted condition is not satisfied, then it is determined that the heating load or the load demanded by defrosting operation is small and therefore operation of the electromagnetic induction heating unit 6 is inhibited. Furthermore, "at the startup of heating operation" refers to the interval of ten minutes since the user started heating operation via the inputting unit (not shown) such as a remote control. Namely, operation transitions to regular heating operation after ten minutes have elapsed since heating operation started.

(Operation Permitted Condition During Regular Heating Operation)

During regular heating operation, the control unit 11 permits the operation of the electromagnetic induction heating unit 6 if the range of the outside air temperature Ta is Ta<−5° C. (refer to the chain single-dashed line in FIG. 7); the range of the indoor temperature Tr is Tr<21° C. (refer to the chain single-dashed line in FIG. 7); the temperature difference ΔTrs calculated by subtracting the indoor temperature Tr detected by the indoor temperature sensor T42 from the indoor set temperature Tse, which serves as the indoor space target set temperature set via an inputting unit (not shown) such as a remote control, exceeds 1K; and the rotational frequency of the compressor 21 exceeds the maximum frequency (in the present embodiment, 184 Hz). Conversely, if the operation permitted condition is not satisfied, then it is determined that the heating load is small and therefore the operation of the electromagnetic induction heating unit 6 is inhibited.

<Characteristics>

In the air conditioner 1 of the present embodiment, at heating operation startup or during defrosting operation, the control unit 11 determines that the heating load is large or the load demanded by defrosting operation is large and permits the operation of the electromagnetic induction heating unit 6 if the range of the outside air temperature Ta is Ta<8° C.; the range of the indoor temperature Tr is Tr<21° C.; the temperature difference ΔTrs calculated by subtracting the indoor temperature Tr detected by the indoor temperature sensor T42 from the indoor set temperature Tse, which serves as the indoor space target set temperature set by an inputting unit such as a remote control, exceeds 1K; and the rotational frequency of the compressor 21 exceeds a maximum frequency.

In addition, in the air conditioner 1, during regular heating operation, the control unit 11 determines that the heating load is large and permits the operation of the electromagnetic induction heating unit 6 if the range of the outside air temperature Ta is Ta<−5° C.; the range of the indoor temperature Tr is Tr<21° C.; the temperature difference ΔTrs calculated by subtracting the indoor temperature Tr detected by the indoor temperature sensor T42 from the indoor set temperature Tse, which serves as the indoor space target set temperature set via an inputting unit (not shown) such as a remote control, exceeds 1K; and the rotational frequency of the compressor 21 exceeds the maximum frequency (in the present embodiment, 184 Hz).

Thus, the control unit 11 determines the magnitude of the heating load of the indoor space or the load demanded by defrosting operation. In addition, the control unit 11 divides the condition for determining the magnitude of the heating load during heating operation into two cases: at startup and during regular heating operation. Accordingly, the control unit 11 can cause the electromagnetic induction heating unit 6 to operate only when the heating load or the load demanded by defrosting operation is large and heating of the refrigerant by the electromagnetic induction heating unit 6 is necessary. Consequently, if the heating load or the load demanded by defrosting operation is large, then the operation of heating the indoor space can be performed quickly and thereby a comfortable space can be provided for the user. In addition, because the electromagnetic induction heating unit 6 is not operated wastefully, it is possible to reduce energy consumption.

<Modified Examples>

(1)

In the air conditioner 1 according to the abovementioned embodiment, the operation permitted condition for the electromagnetic induction heating unit 6 during regular heating operation is set, but does not particularly have to be set. This is because it is conceivable that there are fewer opportunities for the electromagnetic induction heating unit 6 to operate than would be the case at heating operation startup and during defrosting operation. Nevertheless, even during regular heating operation, as in the air conditioner 1 of the present embodiment, determining the operation permitted condition of the electromagnetic induction heating unit 6 and causing the electromagnetic induction heating unit 6 to operate accordingly is effective in that the indoor space is made comfortable for the user when the heating load is large.

(2)

In the air conditioner 1 according to the abovementioned embodiment, under the operation permitted condition at heating operation startup or during defrosting operation, the control unit 11 permits the operation of the electromagnetic induction heating unit 6 if the range of the outside air temperature Ta is Ta<8° C. (refer to the broken line in FIG. 7); the range of the indoor temperature Tr is Tr<21° C. (refer to the broken line in FIG. 7); the temperature difference ΔTrs calculated by subtracting the indoor temperature Tr detected by the indoor temperature sensor T42 from the indoor set temperature Tse, which serves as the indoor space target set temperature set by an inputting unit (not shown) such as a remote control, exceeds 1K; and the rotational frequency of the compressor 21 exceeds the maximum frequency (in the present embodiment, 184 Hz); however, this does not necessarily include the condition wherein the rotational frequency of the compressor 21 exceeds the maximum frequency (in the present embodiment, 184 Hz). This applies also to the operation permitted condition during regular heating operation.

INDUSTRIAL APPLICABILITY

The present invention is useful in an air conditioner for cold regions.

What is claimed is:

1. An air conditioner comprising:

a refrigerant circuit including a compressing mechanism, a heat source side heat exchanger, an expansion mechanism, and a utilization side heat exchanger connected together, the refrigerant circuit being configured to perform a refrigeration cycle to air condition a space such that a temperature of the space approaches a target set temperature;

a heat generating member arranged and configured to thermally contact a refrigerant piping and/or a refrigerant that flows through the refrigerant piping;

an electromagnetic induction heating unit including a magnetic field generating part arranged and configured to generate a magnetic field in order to heat the heat generating member by induction heating;

an air conditioning target space temperature detecting unit arranged and configured to detect the temperature of the space;

an outdoor air temperature detecting unit arranged and configured to detect an outside air temperature; and a control unit configured to inhibit generation of the magnetic field by the magnetic field generating part, wherein the control unit is configured to inhibit, when the refrigeration cycle is performing a startup of a heating operation or a defrosting operation, generation of the magnetic field by the magnetic field generating part in a case in which the temperature of the space and the outside air temperature do not satisfy a first prescribed condition that the temperature of the space and the outside air temperature are in a first temperature region in which the temperature of the space is lower than a first temperature of the space and the outside air temperature is lower than a first outside air temperature or in a case in which a temperature difference between the target set temperature of the space and the temperature of the space does not satisfy a second prescribed condition, and the control unit is further configured to inhibit, when the refrigeration cycle is performing a regular heating operation which is the heating operation except for the startup of the heating operation, generation of the magnetic field by the magnetic field generating part in a case in which the temperature of the space and the outside air temperature deviate from a second temperature region which is within the first temperature region and is narrower than the first temperature region.

2. The air conditioner according to claim I, wherein the heat generating member includes a ferromagnetic material.

3. The air conditioner according to claim 1, wherein the case in which the temperature difference satisfies the second prescribed condition occurs when the temperature difference exceeds a first prescribed temperature at the startup of the heating operation or during the defrosting operation.

4. The air conditioner according to claim 3, wherein the control unit is further configured to inhibit the generation of the magnetic field by the magnetic field generating part if a rotational frequency of the compressing mechanism is less than or equal to a prescribed frequency at the startup of the heating operation or during the defrosting operation.

* * * * *